US007576704B2

(12) United States Patent
Woodward

(10) Patent No.: US 7,576,704 B2
(45) Date of Patent: Aug. 18, 2009

(54) SATELLITE DISH MOUNT

(76) Inventor: Thomas E. Woodward, 825 Arvel Cir., Azle, TX (US) 76020

( * ) Notice: Subject to any disclaimer, the term of this patent is extended or adjusted under 35 U.S.C. 154(b) by 0 days.

(21) Appl. No.: 12/035,623

(22) Filed: Feb. 22, 2008

(65) Prior Publication Data

US 2008/0204353 A1 Aug. 28, 2008

Related U.S. Application Data

(60) Provisional application No. 60/891,611, filed on Feb. 26, 2007.

(51) Int. Cl.
*H01Q 1/12* (2006.01)

(52) U.S. Cl. ..... 343/878; 248/237

(58) Field of Classification Search ..... 343/883, 343/878, 890, 765, 766; 248/237, 323
See application file for complete search history.

(56) References Cited

U.S. PATENT DOCUMENTS 5,647,567 A * 7/1997 Pugh, Jr. et al. ..... 248/237
6,195,066 B1 * 2/2001 Pegues et al. ..... 343/883
6,727,861 B2 * 4/2004 Antoine ..... 343/878
2005/0001781 A1 * 1/2005 Antoine ..... 343/878

* cited by examiner

*Primary Examiner*—HoangAnh T Le
(74) *Attorney, Agent, or Firm*—Charles D. Gunter, Jr.

(57) ABSTRACT

A universal eave mount is shown which is capable of mounting a satellite dish antenna on a structure with a sidewall and a roof with an eave. A base bar, with an initially open interior, attaches to a base plate designed to attach to the sidewall of the structure. An elbow shaped primary dish support, including a generally cylindrical upright leg connected to a generally horizontal leg, is provided. The horizontal leg of the elbow shaped primary dish support is sized to be telescopically inserted into the base bar. A threaded anchor element anchors the elbow shaped primary dish support to the eave of the structure in order to provide a sturdy location to mount a satellite dish antenna on the elbow shaped primary dish support.

2 Claims, 4 Drawing Sheets

SATELLITE DISH MOUNT

CROSS REFERENCE TO RELATED APPLICATION

The present application claims priority from the following U.S. Provisional Application Ser. No. 60/891,611, filed Feb. 26, 2007, entitled "Satellite Dish Mount," and invented by Thomas E. Woodward.

BACKGROUND OF THE INVENTION

1. Field of the Invention

The present invention is directed to an improved eave mount of the type which can be used to mount a satellite dish antenna to a structure with a sidewall, a roof with an eave.

2. Description of the Prior Art

Satellite dishes are commonly encountered objects in today's world. The typical satellite dish is of parabolic design which is particularly adapted for transmitting signals to and/or receiving signals from orbiting satellites. Satellite dishes come in various sizes and designs, and are most commonly used to receive satellite television. In years past, satellite antennas tended to be bulky and cumbersome, and often required placement on tripods or poles in a home owner's yard. The wiring, as well as the actual dish hardware tended to present potential safety hazards as well as being generally bothersome when placed in the yard. However, improvements in antenna technology have allowed the mass distribution of smaller antennas. These smaller antennas exhibit reduced wind and load stress. Due to these changes, satellite antennas can now be mounted directly to a wall or roof of a typical residential or commercial structure.

One requirement for successfully receiving satellite signals is that the satellite dish have a generally unobstructed view of the sky in the direction of the location of a broadcasting satellite. In many areas of the globe, for example the United States, a satellite dish must presently have an unobstructed view to a southerly direction. To achieve this unobstructed southern exposure, the manufacturers commonly recommend several installation locations: strapped to a chimney; mounted on top of a pitched roof; or positioned adjacent the southern wall of a building.

Several problems arise when placing a satellite antenna on the exterior of a chimney. For example, a significant amount of residential homes do not have chimneys. In the instance when a home does have a chimney, the mounted antenna juts out awkwardly and is exposed to soot and possibly intense heat.

Mounting the satellite antenna directly to the roof does not provide an entirely acceptable alternative. Mounting holes must be drilled through the roofing material to a roof rafter. In some cases, the roof rafter is an unacceptable structural support because a tenuously secured antenna tends to sway in high winds and storms, causing a slow but certain breakdown of the roof material under the antenna's base. Furthermore, the roofing material's capability to keep out the weather is compromised because the drilled holes promote roofing material deterioration and eventually can cause a leaking roof. Oftentimes, home owner roof warranties are void if holes have been drilled into the surface of the roof.

There are consequently several disadvantages which are inherent in present day manufacturer mounting recommendations for satellite dish antennas. As a result, the most logical choice for mounting a small satellite dish may be to mount the dish to the eave of the building, as the eave is elevated and permits a wide range of orientations of the dish over the roof of the building. However, manufacturers of the dish satellite antenna often specifically advise users to avoid mounting the antenna on the eave of a house because of the eave's lack of rigidity. If the deficient rigidity could be overcome, an eave would be an ideal location because it allows an installer to avoid mounting the antenna to the chimney or directly to the roof. The eave would provide almost any side of the building for unobstructed signal reception while simultaneously better blending the antenna with the building's profile.

Thus, despite the advances seen in the area of satellite dish mounting technologies, a need exists for an improved mount that overcomes the limitations discussed above.

SUMMARY OF THE INVENTION

The present invention has as its general object to provide an apparatus capable of mounting a satellite dish antenna to a structure with a sidewall, a roof with an eave.

By "eave" is meant that structure which is formed by a sloping roof line that overhangs the sidewall, a downwardly extending edge parallel to the sidewall, and an eave overhang that perpendicularly connects the downwardly extending edge and the sidewall.

The preferred mount of the invention includes abase plate, abase bar, an elbow shaped primary dish support and an anchor element. The base plate attaches the mount to the sidewall of the structure. The elongated base bar has an interior and exterior surface, with an initially open interior, and extends perpendicularly outward from the base plate and generally parallel to the eave overhang. The base bar has a first extent attached to the base plate and an opposite extent terminating in an opening. The elbow shaped primary dish support has a first extent which is telescopically received within the opening in the base bar and a second extent which extends upwardly at a right angle from the first extent when the first extent is received within the base bar. In the preferred embodiment of the present invention the elbow shaped primary dish support includes a generally cylindrical upright leg connected to a generally polygonal, horizontal leg, and the upright leg has a bottom opening for drainage. A threaded anchor element preferably connects the eave mount to a selected one of the eave overhang and the downwardly extending eave edge such that said eave mount provides a sturdy location to mount a satellite dish antenna on the elbow shaped primary dish support. In the preferred embodiment of the present invention, the anchor element is a lag bolt. Means are also provided for locking the telescoping extent of the primary dish support at a selected location within the interior of the base bar.

In one version of the design of the invention, the base bar has at least one bolt-hole opening, which is sized to receive a set screw. The set screw contacts the first extent of the primary dish support to thereby limit the telescopic movement of the first extent within the interior of the base bar. Alternatively, a plurality of holes can be drilled and tapped on each side of the base bar. A minimum of two set screws engage the drilled and tapped holes on either the top or bottom of the base bar and on at least one side thereof to eliminate any side play or up and down movement in the mount. In one preferred form of the device, the cross-section of the first extent of the elbow shaped primary dish support and the base bar is generally polygonal and the cross-section of the second extent of the elbow shaped primary dish support is generally cylindrical. The mating polygonal cross-sections add further stability to the assembly and prevent rotation of the primary dish support.

In another embodiment of the present invention, the upright leg of the elbow shaped primary dish support is welded to the horizontal leg at a tapered weld joint. An opening is formed for drainage at the approximate junction of the weld. In the most preferred form of the invention, the upright leg of the primary dish support is a cylindrical member having a cylindrical bottom opening to allow drainage.

In another embodiment of the invention, the upright leg of the elbow shaped primary dish support is notched to receive the polygonal shape of the horizontal leg of the primary dish support with the two components being butt welded together to produce an elbow.

In yet another embodiment of the present invention, the elbow shaped primary dish support is provided having an initially open interior that terminates in an opening. Thus, the telescoping elements are reversed as compared to the preferred embodiment, wherein the interior surface of the elbow shaped primary dish support is sized to telescopically receive the exterior surface of the base bar. The first extent of the elbow shaped primary dish support has at least one bolt-hole opening sized to receive a set screw for contacting the base bar to thereby limit the telescopic movement of the base bar within the interior of the elbow shaped primary dish support.

Additional objects, features and advantages will be apparent in the written description which follows.

DETAILED DESCRIPTION OF THE INVENTION

Figure 1:
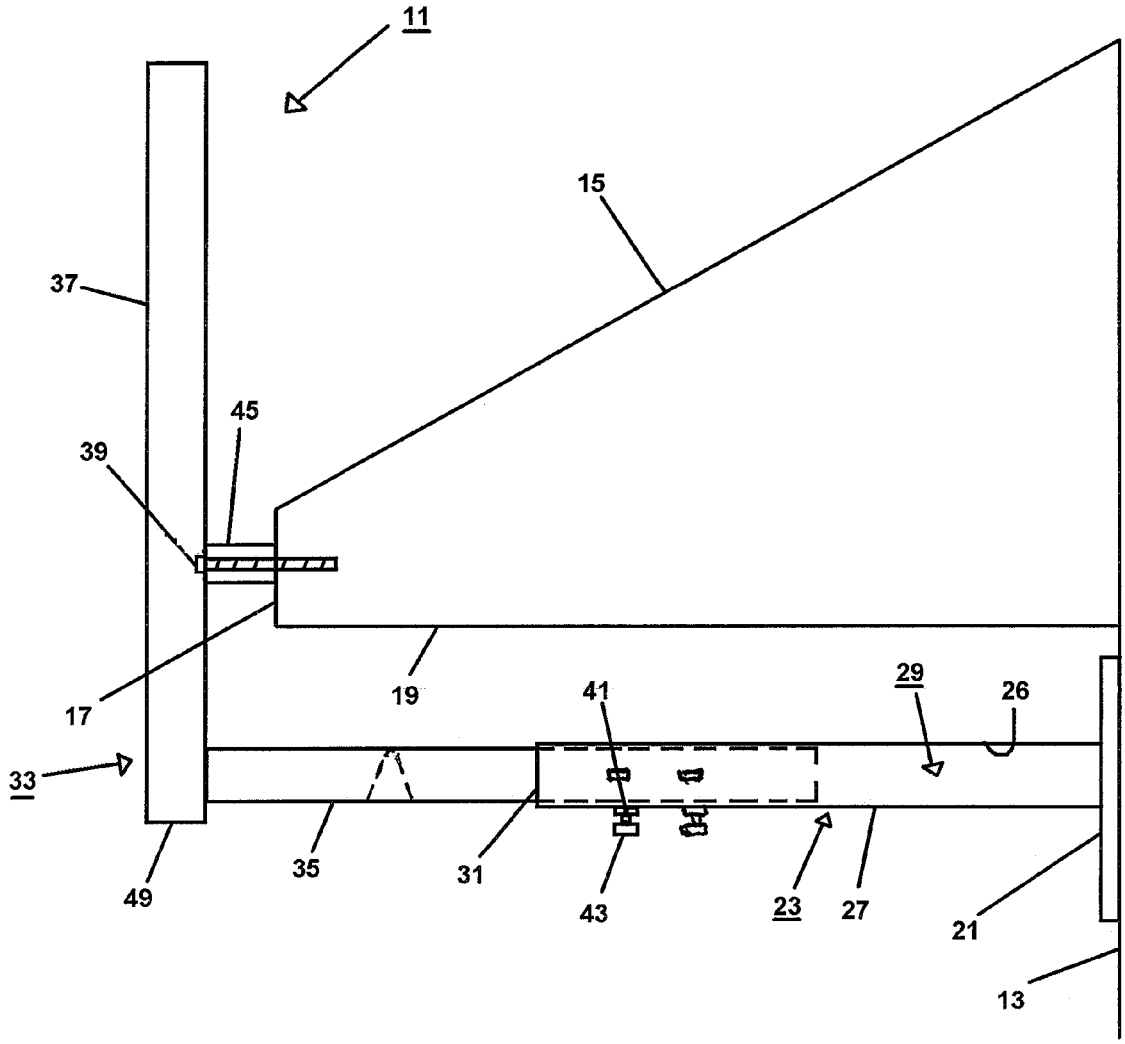
FIG. 1 is a side view of the preferred embodiment of the universal eave mount of the present invention as mounted to a structure and anchored to the downwardly extending edge of the eave.
Figure 2:
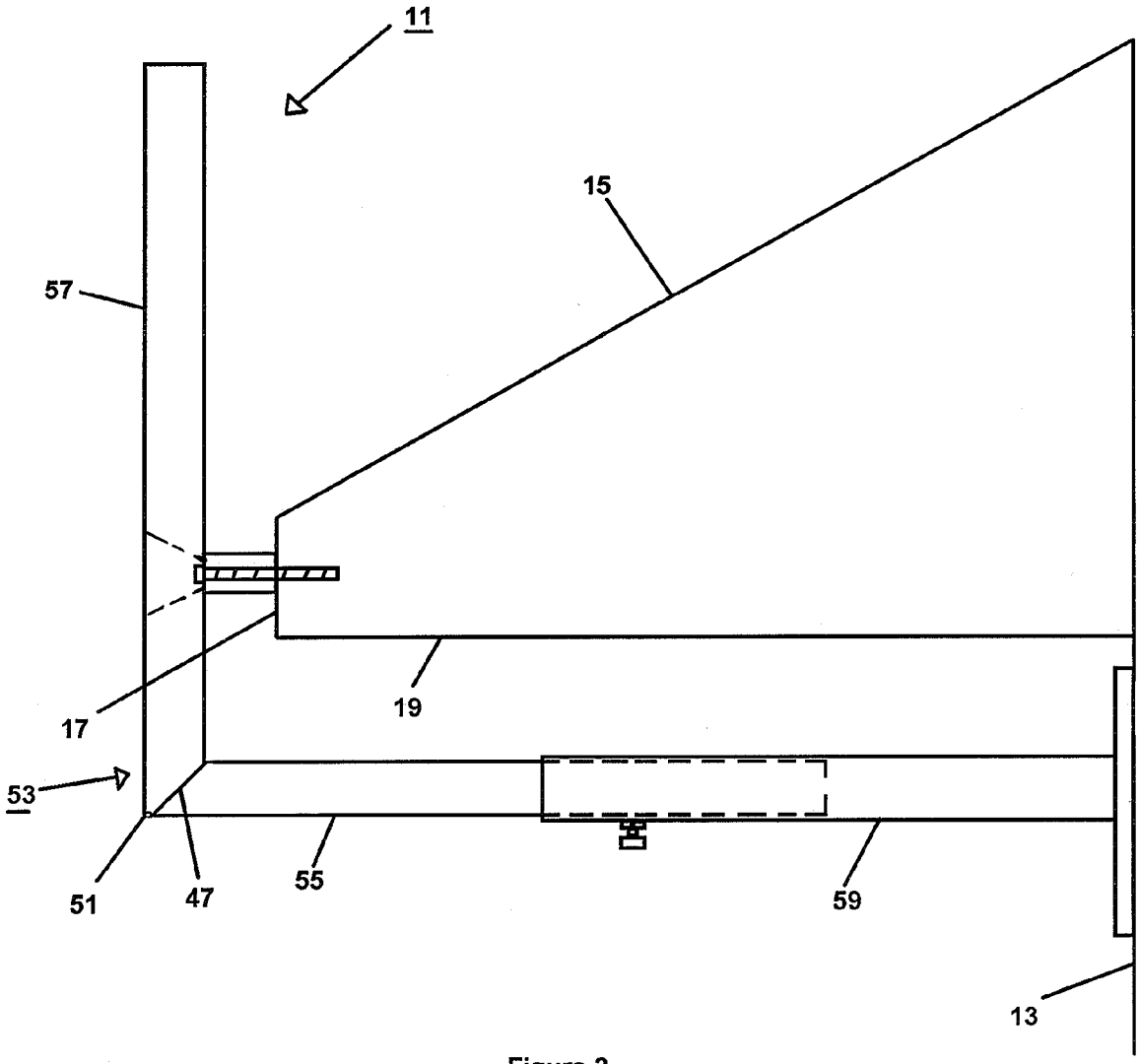
FIG. 2 is a side view of another embodiment of the universal eave mount of the present invention as mounted to a structure, wherein the first and second extents of the elbow shaped primary dish support are welded together to form a tapered weld joint.
Figure 3:
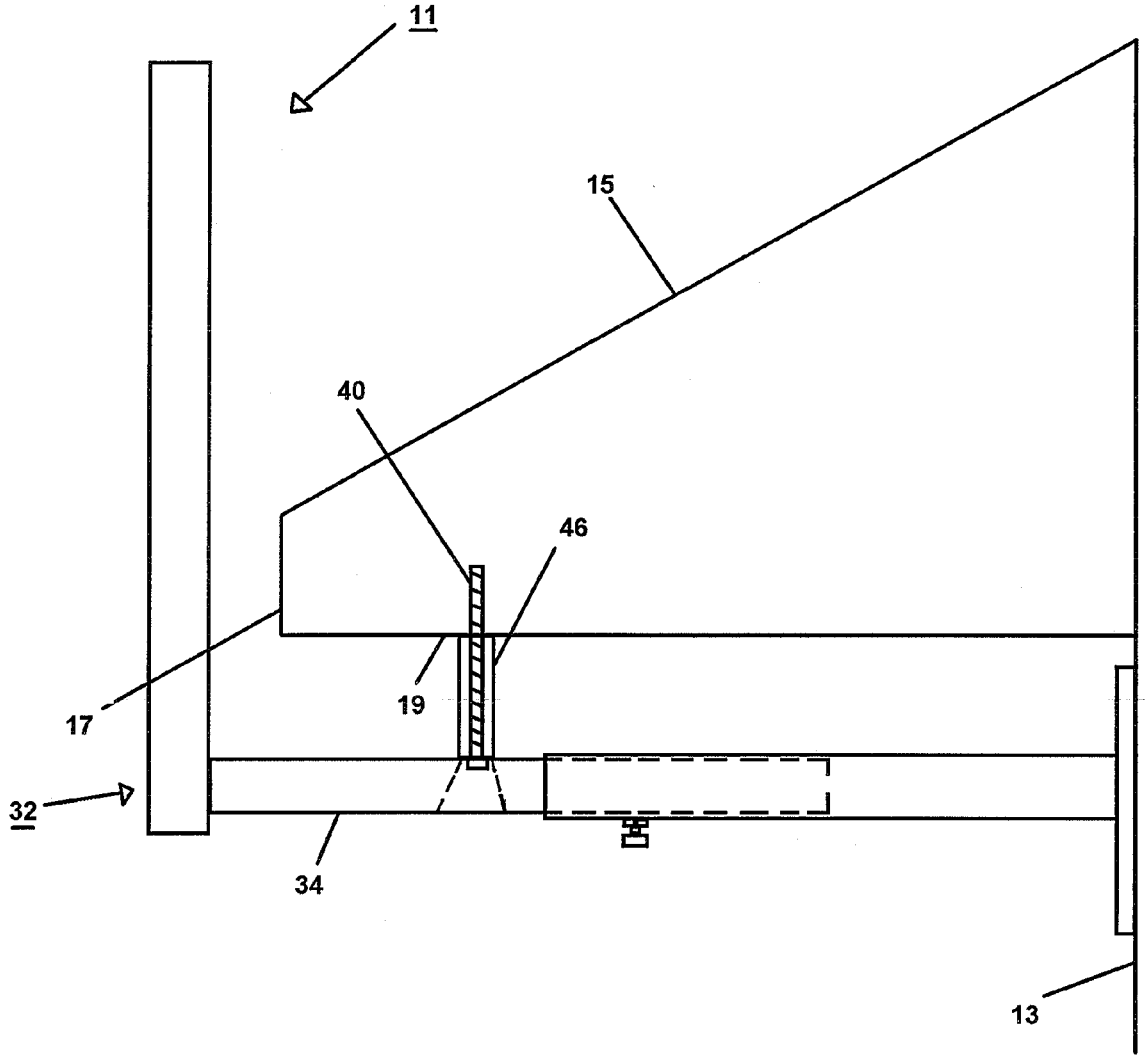
FIG. 3 is a side view of another embodiment of the universal eave mount of the present invention as mounted to a structure and anchored to the eave overhang.

Turning to FIGS. 1-3, there is illustrated a typical environment of intended use for the universal eave mount of the present invention. The universal eave mount, shown generally as 11, is capable of mounting a satellite dish antenna to a structure with a sidewall and a roof with an eave. For purposes of the discussion of the present invention, an eave is defined by a sloping roof line 15, contiguous with the roof, that overhangs the sidewall 13, a downwardly extending edge 17 parallel to the side wall 13, and an eave overhang 19 that perpendicularly connects the downwardly extending edge and the sidewall.

In its most general form, the universal eave mount of the present invention is comprised of a base plate, a base bar, an elbow shaped primary dish support and a threaded anchor element. The universal eave mount can be used on all types of eaves, regardless of the sloping roof line angle or eave overhang length.

Turning to FIG. 1, there is shown an illustration of the preferred embodiment of the present invention. The base plate 21 attaches the mount 11 to the sidewall 13 of the structure. The base plate 21 has a plurality of pre-drilled holes that are used to anchor the eave mount to the sidewall. The pre-drilled holes are sized to receive a corresponding lag screw, or bolt, which is then drilled into the sidewall in order to anchor the base plate 21. The base plate 21 may differ in size depending on the application, but should be large enough to withstand the torque requirements necessary to keep the eave mount 11 squarely attached to the sidewall. The base plate 21 is capable of being mounted on virtually any commonly used sidewall material, i.e., solid wood, lap siding, brick, poured concrete, hollowed wall, or cinder block wall. The elongated base bar 23 has an interior surface 26 and exterior 27 surface, with an initially open interior (shown generally as 29). The base bar 23 has a first extent attached to the base plate 21 and an opposite extent terminating in an opening 31. The base bar 23 extends perpendicularly outward from the base plate 21 and generally parallel to the eave overhang 19. In the preferred embodiment of the present invention, the base bar 23 is tack welded to the base plate 21.

The elbow shaped primary dish support 33 has a first extent 35 and a second extent 37. The first extent is sized so that it is capable of being telescopically received within the opening 31 in the base bar 23. The second extent 37 extends upwardly at a right angle from the first extent 35 when the first extent 35 is received within the base bar 23. In the preferred embodiment of the present invention the second extent 37 of the elbow shaped primary dish support 33 is generally a cylindrical upright leg and is connected, as by welding, to the first extent 35 which comprises a polygonal, i.e., square or rectangular in cross-section, generally horizontal leg, as shown in FIG. 1. The first extent 35 may be continually inserted into the opening 31 of the base bar 27 until the upright leg 35 is located adjacent the downwardly extending edge 17 of the eave. In this manner, the universal eave mount 11 can compensate for all sizes of eaves by allowing continual sliding adjustment for the appropriate length of the eave overhang 19. The upright leg 35 has an interior and exterior surface, wherein the interior is initially open and a bottom opening 49 exists for drainage.

In one version of the device of the invention, the polygonal (square) tubing of the first extent of the primary dish support is fitted within a notch cut in one side of the cylindrical second extent of the primary dish support and the two components are butt welded together to produce the elbow. This provides a cleaner look to the installation by providing the ability to run any associated electrical wires from the satellite down the cylindrical tube, rather than on the outside of the tube. This also better protects the wires from the elements while at the same time providing additional drainage for the upright leg.

The base bar 27 has at least one bolt-hole opening 41, which is sized to receive a set screw 43. The set screw 43 contacts the first extent 35 of the primary dish support 33 to thereby limit the telescopic movement of the first extent 35 within the interior 29 of the base bar 27. As has been mentioned, the cross-section of the first extent 35 of the elbow shaped primary dish support 33 and the base bar 27 is generally polygonal and the cross-section of the second extent 37 of the elbow shaped primary dish support 33 is generally cylindrical in the preferred form of the invention. In a preferred version of the invention, two holes are drilled and tapped on each side of the square base bar 27 for a total of eight holes. Not all of the drilled and tapped holes are used at one time, depending upon the exact mounting of the base plate 21 and how it is positioned with respect to the wall of the structure. A minimum of two set screws will be used, one on either the top or bottom of the square base bar 27 and one on either of the opposing sides thereof, in order to eliminate any side play or up and down movement of the mount and further secure it to the base plate 21.

A threaded connector, such as the threaded anchor element 39, connects the eave mount 11 to the eave, whereby the eave mount 11 provides a sturdy location for mounting a satellite dish antenna. The anchor element acts to keep the elbow shaped primary dish support 33 tightly engaged with the mounting surface to insure that the mount 11 is secured and properly installed. FIGS. 1 and 2 depict the eave mount 11 attaching to the downwardly extending eave edge 17. The threaded anchor element 39 passes through the second extent 37 of the elbow shaped primary dish support 33 and into the downwardly extending eave edge 17. However, FIG. 3 illustrates another version of the mount of the invention in which the eave mount 11 attaches to the eave overhang 19. The threaded anchor element 40 passes through the first extent 34 of the elbow shaped primary dish support 32 and into the eave overhang 19. This is appropriate when the downwardly extending edge 17 does not provide an adequate anchoring surface, i.e., is too small or too angled. In addition, attaching to the eave overhang 19 is sometimes necessary if the structure has a rain gutter system that is already installed along the downwardly extending edge 19. In the various embodiments of the present invention illustrated in the drawings, the anchor element (element 39 in FIGS. 1 and 2 element 40 in FIG. 3) is a lag bolt. A spacer, shown as element 45 in FIG. 1 or element 46 in FIG. 3, may provide additional support depending on the weight of the equipment being used.

Another version of the eave mount of the present invention is illustrated in FIG. 2 of the drawings. The universal eave mount 11 is shown in the same general environment as described above and illustrated in FIG. 1. The elbow shaped primary dish support 53 has a first extent 55 and a second extent 57. The second extent 57 extends upwardly at a right angle from the first extent 55 when the first extent 55 is received within the base bar 59. The second extent 57, or the upright leg, of the elbow shaped primary dish support 33 is welded to the first extent 55, or the horizontal leg of the elbow shaped primary dish support 33, at a tapered weld joint, as shown generally at location 47. Unlike the previously described embodiment, drainage cannot exit freely from a drainage opening at the bottom of the second extent 57. Therefore, an opening is formed, as by drilling a hole, for drainage at the approximate junction of the weld, shown at location 51.

Figure 4:
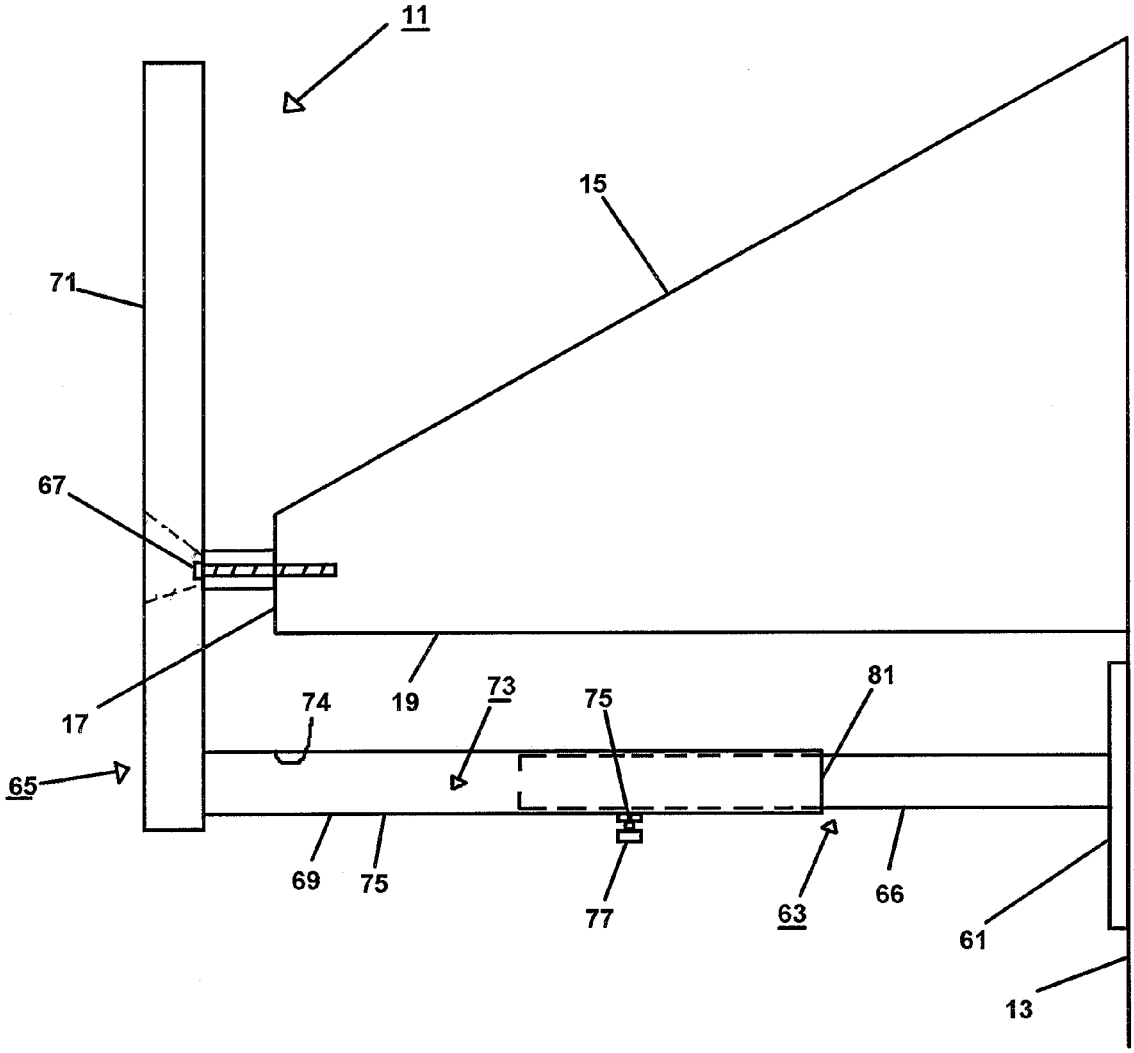
FIG. 4 is a side view of yet another embodiment of the universal eave mount of the present invention wherein the base bar is telescopically received within the elbow shaped primary dish support.

Yet another version of the eave mount of the present invention is illustrated in FIG. 4 of the drawings. The universal mount 11 is shown as comprising a base plate 61, a base bar 63, an elbow shaped primary dish support 65 and a threaded anchor element 67. The base bar 63 has and interior and exterior 66 surface and a first extent attaching to the base plate 61 and a second opposing extent. The elbow shaped primary dish support 65 has a first extent 69 with an interior 74 and exterior 75 surface and an initially open interior 73 that terminates in an opening 81. The interior surface 74 of the first extent 69 is sized to telescopically receive the exterior surface 66 of the second extent of the base bar 63. The first extent 69 of the elbow shaped primary dish support 65 has a bolt-hole opening 75, sized to receive a set screw 77. The set screw 77 contacts the second extent of the base bar 63 to thereby limit the telescopic movement of the second extent of the base bar 63 within the interior of the elbow shaped primary dish support 65.

The eave mount can be produced economically from readily available materials. For example, suitable materials include steel, aluminum, cast iron, iron, plastic, graphite, nylon, fiber, glass, Teflon, wood fiber, and other types of hardening substances or other mold injected materials. The wall thickness of the various components can also vary in size as to accommodate the intended use of the mount. Additionally, each attached point of the universal eave mount could be hinged or have a swinging bracket.

In each embodiment of the present invention, the base bar and the first extent of the elbow shaped primary dish support are appropriately sized to telescopically mate. However, the circumference of the second extent of the elbow shaped primary dish support can differ in size, depending on the size of the dish antenna that is to be mounted. The universal eave mount of the invention thus provides an inherent advantage in its design, in that once the base plate is mounted, if for any reason the user wishes to upgrade to a larger or smaller dish, the only change that is required is the replacement of the elbow shaped primary dish support. Since all elbows are interchangeable this allows for any upgrades or changes in the future.

An invention has been provided with several advantages. The universal eave mount allows a user to install a satellite dish while relieving the probable damage to a roof, and does not void home owner warranties by requiring penetration into the roof. The mount also simplifies the installation process and makes cable runs cleaner. Since the mount bolts to the sidewall under the roofs overhang, as opposed to the roof itself, a more secure mounting surface is provided. The mount also telescopes to adjust for homes with and without gutters. Telescoping also allows for different widths of eves and roof overhangs.

Where the invention is shown in several of its forms, it is not thus limited but is susceptible to various changes and modifications without departing from the spirit thereof.

What is claimed is:

1. A universal eave mount for mounting a satellite dish antenna to a structure with a sidewall and a roof with an eave, where the eave is formed by a sloping roof line, contiguous with the roof, that overhangs the sidewall, a downwardly extending edge parallel to the side wall, and an eave overhang that perpendicularly connects the downwardly extending edge and the sidewall, the universal eave mount comprising:

a base plate for attaching the mount to the sidewall of the structure;

an elongated base bar with interior and exterior surfaces and an initially open interior, said base bar extending perpendicularly outward from the base plate and generally parallel to the eave overhang, said base bar having a first extent attached to the base plate and an opposite extent terminating in an opening;

an elbow shaped primary dish support having a first extent which is telescopically received within the opening in the base bar and having a second extent which extends upwardly at a right angle from the first extent when the first extent is received within the base bar, the two extents of the primary dish support being connected by first forming a polygonal notch opening in the second extent which receives a mating polygonal end of the first extent of the primary dish support which is subsequently welded thereto to form the elbow, the elbow shaped primary dish support including a generally cylindrical upright leg connected to a generally horizontal leg, the upright leg having a bottom opening for drainage;

a threaded anchor element connecting the eave mount to a selected one of the eave overhang and downwardly extending eave edge such that said eave mount provides a sturdy location to mount a satellite dish antenna on the elbow shaped primary dish support; and wherein the base bar has a top, a bottom and opposing sidewalls, and wherein a plurality of tapped holes are present on the base bar which receive at least two set screws, one of the screws being contained in a hole on either the top or bottom of the base bar and the other set screw being contained in a hole on a selected side of the base bar.

2. A universal eave mount for mounting a satellite dish antenna to a structure with a sidewall and a roof with an eave, where the eave is formed by a sloping roof line, contiguous with the roof, that overhangs the sidewall, a downwardly extending edge parallel to the side wall, and an eave overhang that perpendicularly connects the downwardly extending edge and the sidewall, the universal eave mount comprising:

a base plate for attaching the mount to the sidewall of the structure;

an elongated base bar with interior and exterior surfaces, said base bar extending perpendicularly outward from the base plate and generally parallel to the eave overhang, said base bar having a first extent attached to the base plate and an opposite extent;

an elbow shaped primary dish support having a first extent with an end opening which is telescopically received about the opposite extent of the base bar and having a second extent which extends upwardly at a right angle from the first extent when the first extent is received about the base bar;

the two extents of the primary dish support being connected by first forming a polygonal notch opening in the second extent which receives a mating polygonal end of the first extent of the primary dish support which is subsequently welded thereto to form the elbow, the elbow shaped primary dish support including a generally cylindrical upright leg connected to a generally horizontal leg, the upright leg having a bottom opening for drainage;

a threaded anchor element connecting the eave mount to a selected one of the eave overhang and downwardly extending eave edge such that said eave mount provides a sturdy location to mount a satellite dish antenna on the elbow shaped primary dish support; and wherein the first extent of the primary dish support has a top, a bottom and opposing sidewalls, and wherein a plurality of tapped holes are present on the primary dish support's first extent which receive at least two set screws, one of the screws being contained in a hole on either the top or bottom of the first extent and the other set screw being contained in a hole on a selected side of the first extent thereof.

* * * * *